United States Patent [19]

Westphal et al.

[11] Patent Number: 4,907,485

[45] Date of Patent: Mar. 13, 1990

[54] METHOD FOR THE ATTACKING OF A TARGET OBJECT FROM AN OVERFLYING PROJECTILE AND OVERFLYING PROJECTILE FOR IMPLEMENTING THE METHOD

[75] Inventors: Robert Westphal, Nuremberg; Wolfgang Babel, Rothenbach, both of Fed. Rep. of Germany

[73] Assignee: Diehl GmbH & Co., Nuremberg, Fed. Rep. of Germany

[21] Appl. No.: 359,529

[22] Filed: Jun. 1, 1989

[30] Foreign Application Priority Data

Jun. 23, 1988 [DE] Fed. Rep. of Germany ..... 3821218

[51] Int. Cl.[4] ..... F41G 9/00; F42B 13/10

[52] U.S. Cl. ..... 89/1.11; 102/476; 244/3.1

[58] Field of Search ..... 244/3.1, 3.15; 89/1.11; 102/476

[56] References Cited

U.S. PATENT DOCUMENTS

| | | | |
|---|---|---|---|
| 3,538,809 | 11/1970 | Maydell | 244/3.1 |
| 4,262,596 | 4/1981 | Allier et al. | 102/476 |
| 4,494,437 | 1/1985 | Maydell | 89/1.11 |
| 4,530,270 | 7/1985 | Denaci | 89/1.11 |
| 4,532,867 | 8/1985 | Mitchell | 102/213 |
| 4,657,208 | 4/1987 | Miller, Jr. et al. | 102/476 |
| 4,711,412 | 12/1987 | Wallermann | 244/3.15 |

FOREIGN PATENT DOCUMENTS

| | | | |
|---|---|---|---|
| 0084007 | 7/1983 | . | |
| 2815206 | 10/1979 | Fed. Rep. of Germany . | |
| 3525546 | 2/1986 | Fed. Rep. of Germany . | |
| 3620311 | 12/1987 | Fed. Rep. of Germany . | |
| 2425049 | 1/1980 | France | 244/3.15 |
| 2149066 | 6/1985 | United Kingdom | 102/476 |
| 2161907 | 1/1986 | United Kingdom | 102/476 |
| 2167536 | 5/1986 | United Kingdom . | |
| 2133514 | 11/1986 | United Kingdom . | |

*Primary Examiner*—Charles T. Jordan

*Attorney, Agent, or Firm*—Scully, Scott, Murphy & Presser

[57] ABSTRACT

A method for the attacking of a target object from an overflying projectile, and wherein the projectile is equipped with a target detector for the activation of its warhead. Moreover, there is disclosed an overflying projectile which is equipped with a downwardly oriented target detector and with a warhead which is activated in dependence upon the target detection for the attacking of the target object. The method contemplates that the projectile be guided into a lower altitude of flight for the scanning of the target area, and upon detection of a target object is pulled up steeply into an ascending path, which has its tail end oriented towards the target object, so as to launch the warhead opposite the direction of flight which is in an ascending trajectory from the tail end of the projectile in a direction towards the target object.

6 Claims, 1 Drawing Sheet

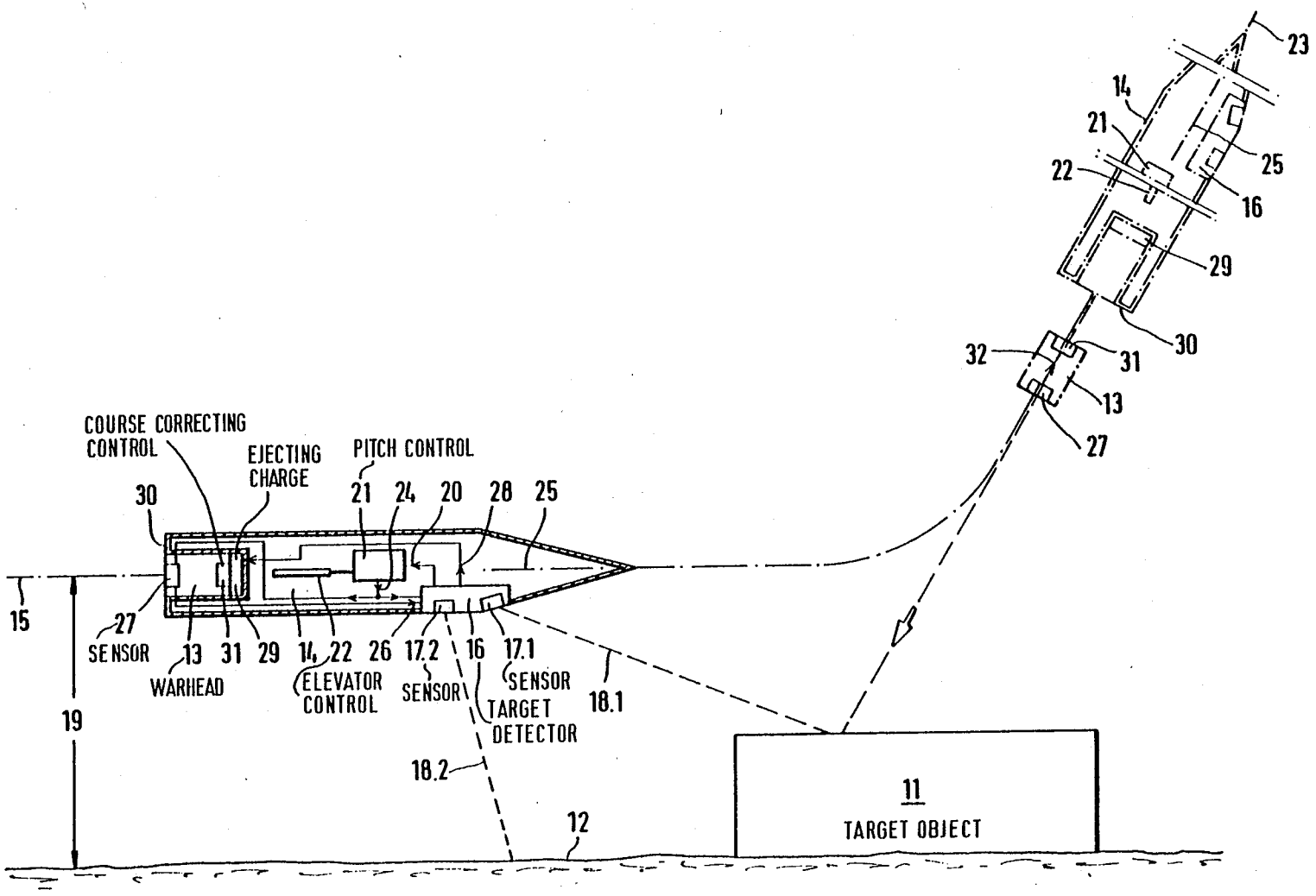
11
TARGET OBJECT
COURSE CORRECTING CONTROL
EJECTING CHARGE
PITCH CONTROL
SENSOR
WARHEAD
ELEVATOR CONTROL
SENSOR
TARGET DETECTOR
SENSOR
18.1
18.2
12
15
19
23
25
16
29
30
31
13
27
32
14
21
22
20
24
26
17.1
17.2

METHOD FOR THE ATTACKING OF A TARGET OBJECT FROM AN OVERFLYING PROJECTILE AND OVERFLYING PROJECTILE FOR IMPLEMENTING THE METHOD

BACKGROUND OF THE INVENTION

1. Field of the Invention

The present invention relates to a method for the attacking of a target object from an overflying projectile, and wherein the projectile is equipped with a target detector for the activation of its warhead. Moreover, the invention relates to an overflying projectile which is equipped with a downwardly oriented target detector and with a warhead which is activated in dependence upon the target detection for the attacking of the target object.

2. Discussion of the Prior Art

Measures of the kind which are under consideration herein are already presently known from the disclosure of British Published Patent Appln. 2,133,514. In that particular instance, it is contemplated to trigger or activate a warhead possessing a projectile-forming hollow charge, when a sensor which is oriented forwardly at a downward angle has acquired a target object which is to be attacked, and this target object is again detected shortly thereafter during overflight through the intermediary of a vertically downwardly oriented sensor. However, the problem is always encountered that at a low-level altitude of overflight which is intended to be achieved due to reasons of low probability of detection by enemy radar, the point in time for the precision-hitting release of the warhead becomes excessively critical. It is further disadvantageous that the necessarily relatively high speed of overflight, and the large transverse or cross-components relative to the direction of action of the warhead which result therefrom, will adversely influence the effect of the latter on the target. Thus, it is also already known from the disclosure of German Laid-Open Patnet Appln. 35 25 546 to shift the direction of action of a warhead in an overflying projectile in conformance with the extent of the change in the line of sight to the target, so as not be restricted to the short moment of the actual overflying of the target for effecting the release of the warhead. The demand on guidance technology for such inclusion in the orientation for the warhead; however, is considerably extensive, and the problems encountered by the components of movement which oriented deviatingly from the direction of action is only reduced by means of such measures, but is not completely overcome.

Target attacking conditions which appear to promise success for an effect on the target are obtained when, in accordance with the disclosure of German Patent 28 15 206, the projectile additionally flies away over the detected target object in order, to a certain extent in a rearward balance or clearance, attain some altitude and then to attack this target object practically vertically in a steep or crash dive. However, in this instance, again there are encountered problems in the reacquisition of the target object which was previously detected from completely different conditions of flight; and the looping guidance for target attack in a steep crash dive presents from the beginning quite extraordinary demands on the precise maneuverability of the projectile, and on correspondingly rapidly operating detectors for the redetection and subsequent exact homing against the target object.

SUMMARY OF THE INVENTION

Accordingly, in recognition of these conditions, it is an object of the present invention to provide a method and a projectile of the type which is under consideration herein which, from a lower-level searching trajectory, produce a higher degree of target attacking effectiveness.

The foregoing object is inventively achieved in that for measures of the type which is considered herein the method contemplates that the projectile be guided into a lower altitude of flight for the scanning of the target area, and upon detection of a target object is pulled up steeply into an ascending path, which has its tail end oriented towards the target object, so as to launch the warhead opposite the direction of flight whichis in an ascending trajectory from the tail end of the projectile in a direction towards the target object.

Pursuant to another object of the invention, the overflying projectile of the type described herein is equipped with a directional control which is acted upon from the target detector, which upon detection of the target will guide the projectile from its searching trajectory at a low altitude of flight above the target area into a relatively steeply ascending trajectory, in which a tail end or rearwardly-facing sensor maintains the longitudinal axis of the projectile oriented towards the target object so as to be able to launch the warhead in a direction opposite that of the ascending trajectory.

The essential advantage of this object resides in that there can be carried out a transfer of the target acquisition data from the sensors which are oriented somewhat transversely of the movement of the projectile to a tail end-sensor, when the overflying projectile is guided out of its low-level searching trajectory extending generally somewhat in parallel with the target area during overflights of targets into a relatively steeply ascending trajectory or path of flight, and thereby again positively detecting this target object at its tail end in an extrapolation of the longitudinal axis of the projectile, and thereby by means of the tail-end sensor. Therefore, it is not necessary that because of the flying maneuvers subsequent to target detection the target need again by completely newly discovered. The informations obtained from the tail-end sensor, through the direction control of the airborne body, cause the ascending trajectory to be maintained in its rearward extrapolation towards the target object (in essence, with the longitudinal axis of the airborne body). Consequently, this will ensure the highest possible hitting accuracy, when from this ascending trajectory there is activated the warhead which is arranged coaxially in the tail end portion of the airborne body, preferably expelled by means of an ejecting charge, in a direction opposite the ascending path of flight towards the target object. With regard to this warhead, the latter can pertain to an inertial or tandem projectile for the piercing through of the earth embankment and concrete armorings of a protective structure (referring; for example, to European Patent 084 007) or may relate to intelligent ammunition; in the last instance, generally either unguided or guided search head-submunition with projectile-forming hollow charges (as shown in British Patent Appln. 2,167,536) against stationary or movable target objects.

Additional alternatives and modifications, as well as further features and advantages of the invention may now be readily ascertained from the following detailed description as set forth hereinbelow, taken in conjunction with a generally schematic representation of an exemplary embodiment for implementing the inventive method, in which the single FIGURE of the drawing illustrates, in a longitudinal sectional view, the course of a projectile in overflight relative to a detected target object which is to be attacked.

DETAILED DESCRIPTION

A target object 11 which is to be attacked may pertain to a stationary object, such as a protective structure or shelter, or to a movable object, such as an armored vehicle, within a previously reconnoitered target area 12. The target object 11 should be attacked through the intermediary of a warhead 13 of an overflying projectile 14, which projectile surveys the target area 12 from a low-level flight searching trajectory 15 through the utilization of a forwardly oriented target detector 16 which is angled downwardly relative to the searching trajectory 15. Expediently, this detector incorporates a plurality of sensors 17.1, 17.2 which are oriented at different inclinations, so that the target determination given under a level detecting direction 18.1 investigates shortly subsequent to a steeper detecting direction 18.2 and, upon occasion, can be confirmed, as is already known per se.

The angle of inclination or slope subtended intermediate the two detecting directions 18.1 and 18.2 is selected in such a manner relative to the altitude of flight 19 that, on the one hand, upon a first target determination there remains in the target detector 16 adequate signal-processing time for the target classification on the basis of specified target pattern informations during the continuing flight of the projectile 14, and, on the other hand, possibly also in parllel with the target detection, there is determined the surroundings about the target in the second direction 18.2, in order to achieve a higher probability of detection on the basis of information which is specific to the target in comparison with environmental informations; for example, having reference to the disclosure of U.S. Pat. No. 4,532,867.

When the detection of a target object 11 which is to be attacked is sufficiently assured (through either a single or repetitive target detection), the target detector 16 delivers a control signal 20 to the pitch control 21 for the projectile 14. This actuation, for example, through the intermediary of elevator controls 22, causes the previous trajectory 15 to be converted into a steeply ascending trajectory or path of flight 23. By means of a switching signal 24, the sensors 17.1, 17.2 which are oriented at an angle relative to the longitudinal axis 25 of the projectile are switched off and, instead thereof, a tail-end or rear sensor 27 which is rearwardly oriented along the longitudinal axis 25 is switched to the (or to another) target detector 16. The informations 26 obtained fro the latter are compared with applicable informations for verification of the target object, which were obtained and stored immediately prior thereto through the inclined-oriented sensors 17.1, 17.2, so as to then deliver such control signals 20 to the directional control 21, such that the longitudinal axis 25 of the projectile will remain at its trailing end within the ascending trajectory 25 oriented as closely as possibly against the target object 11.

When the (repeated) determination of the target object 11 which is to be attacked is thusly confirmed by the tail-end sensor 27, the target detector 16 delivers a triggering information 28 for the actuation of a somewhat pyro-electrically triggerable ejecting charge 29, and to thereby accelerate the warhead 13 opposite the direction of flight of the projectile along the ascending trajectory 23 from the tail end 30 of the projectile in a direction towards the target object 11.

This warhead 13 may pertain to an unguided active member; for instance, such as an inertial projectile or a tandem warhead for piercing through the camoflage and armoring of the target object 11. However, it can also relate to such a search head-equipped warhead 13 which, in a known manner, spirally scans the target area 12 (which has already been restricted in size by the function of the overflying target detector 16), and upon determining a target object will trigger a warhead possessing hollow charges. In the same manner, the tail end sensor 27 can also be designed for an intelligent warhead 13 to store a directional or course-correcting control 31 with target depot or deployment informations 32 whereby, through a discontinuous or continuous final flight phase-guidance to still further increase the hitting probability, especially for a moving target object 11.

What is claimed is:

1. A method for the attacking of a target object from an overflying projectile, said projectile having a warhead; and a target detector for the launching of said warhead, comprising guiding said projectile for scanning of a target area at a low altitude of flight; and upon detecting of a target object detection pulling said projectile into a steeply ascending trajectory having the trailing end thereof directed towards the target object so as to initiate said warhead opposite the direction of the ascending trajectory from the tail end of the projectile in a direction towards the target object.

2. An overflying projectile including a downwardly oriented target detector and a warhead for attacking a target object in dependence upon actuation responsive to target detection; a directional control acted upon by the target detector so as to upon detection of a target guide the projectile from a searching trajectory at a low-level trajectory above the target area into a steeply ascending trajectory; and a tail end sensor in said projectile maintaining the longitudinal axis of the projectile oriented towards the target object so as to launch the warhead in a direction opposite the ascending trajectory.

3. A projectile as claimed in claim 2, wherein the warhead comprises an ejection charge for starting the projectile opposite the direction of the ascending trajectory towards the target object.

4. A projectile as claimed in claim 2, wherein the warhead is a component of an article of intelligent submunition.

5. A projectile as claimed in claim 4, wherein the warhead is a component of an article of submunition equipped with a search head.

6. A projectile as claimed in claim 3, wherein the warhead is a component of an article of submunition with trajectory-correcting control means.

* * * * *